US006322943B1

(12) United States Patent
Aoki et al.

(10) Patent No.: US 6,322,943 B1
(45) **Date of Patent: *Nov. 27, 2001**

(54) LIGHT-RECEIVING MEMBER, IMAGE FORMING APPARATUS HAVING THE MEMBER, AND IMAGE FORMING METHOD UTILIZING THE MEMBER

(75) Inventors: Makoto Aoki, Joyo; Shigenori Ueda; Junichiro Hashizume, both of Nara, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/057,554

(22) Filed: Apr. 9, 1998

(30) Foreign Application Priority Data

Apr. 14, 1997 (JP) ..... 9-113390
Mar. 31, 1998 (JP) ..... 10-103770

(51) Int. Cl.[7] ..... G03G 5/147
(52) U.S. Cl. ..... 430/66; 430/67; 430/132; 399/159
(58) Field of Search ..... 430/66, 67, 84, 430/132; 136/258; 399/159

(56) References Cited

U.S. PATENT DOCUMENTS

| | | | |
|---|---|---|---|
| 4,265,991 | 5/1981 | Hirai et al. | 430/64 |
| 4,664,999 | 5/1987 | Kakinuma et al. | 430/67 |
| 4,770,966 | 9/1988 | Kazama et al. | 430/66 |
| 5,392,098 | 2/1995 | Ehara et al. | 355/219 |

(List continued on next page.)

FOREIGN PATENT DOCUMENTS

| | | | |
|---|---|---|---|
| 3610076 | 10/1986 | (DE) | G03G/5/14 |
| 60-12554 | 1/1985 | (JP) . | |
| 61-289354 | 12/1986 | (JP) . | |
| 211659 | 9/1987 | (JP) . | |
| 63-65447 | 3/1988 | (JP) . | |
| 6-186764 * | 7/1994 | (JP) . | |
| 240925 | 9/1996 | (JP) . | |

OTHER PUBLICATIONS

Borsenberger, Paul M. & Dacid S. Weiss. Organic Photoreceptors for Imaging Systems. New York: Marcel–Dekker, Inc. pp. 6–17, 1993.*

(List continued on next page.)

*Primary Examiner*—Christopher Rodee
(74) *Attorney, Agent, or Firm*—Fitzpatrick, Cella, Harper & Scinto

(57) ABSTRACT

There is provided a light-receiving member comprising a photoconductive layer provided on an electroconductive substrate, and a surface layer provided on the photoconductive layer, the surface layer comprising non-single-crystal carbon containing at least fluorine, wherein the surface layer has a ratio of the area of a peak having center in the vicinity of 1200 $cm^{-1}$ or 1120 $cm^{-1}$ in the infrared absorption spectrum to the area of a peak having center in the vicinity of 2920 $cm^{-1}$ being in a range from 0.1 to 50. The light-receiving member allows to obtain a high-quality image without faint image or smeared image in any ambient conditions without use of heating means for the light-receiving member, and has high durability enough for maintaining such high quality characteristics. It can also prevent, by the absence of the heating means, the adhesion of low melting toners such as color toners and the unevenness in image density, generated at the rotating interval of the developer. Besides, it has a high sensitivity, is free from image defects resulting from charge leaking, and is capable of stably providing high-quality images without change with elapse of time.

16 Claims, 5 Drawing Sheets

U.S. PATENT DOCUMENTS

| | | | | |
|---|---|---|---|---|
| 5,536,610 | | 7/1996 | Ojima et al. | 430/67 |
| 5,582,944 | | 12/1996 | Yamamura et al. | 430/66 |
| 5,840,455 | * | 11/1998 | Ikuno et al. | 430/66 |
| 5,849,445 | * | 12/1998 | Visser et al. | 430/66 |

OTHER PUBLICATIONS

Patent Abstracts of Japan, vol. 12, No. 288 (P–741) 1988 for JP 63–65447.

Database WPI, Section Ch, Week 8837, Derwent Public. AN88–261641, XP002084400 for JP 63–191152.

Curtins, et al., Influence of Plasma Excitation Frequency for a Si:H Thin Film Deposition, Plasma Chemistry and Plasma Processing, vol. 7, No. 3, pp. 267–273 (1987).

* cited by examiner

LIGHT-RECEIVING MEMBER, IMAGE FORMING APPARATUS HAVING THE MEMBER, AND IMAGE FORMING METHOD UTILIZING THE MEMBER

BACKGROUND OF THE INVENTION

1. Field of the Invention

The present invention relates to a light-receiving member, an image forming apparatus having the member, and an image forming method utilizing the member, and more particularly to a light-receiving member with excellent characteristics free from causing drawbacks such as a faint image or a smeared image regardless of the ambient conditions and without heating the light-receiving member, and capable of maintaining such characteristics, also an image forming apparatus having such light-receiving member and an image forming method utilizing such light-receiving member.

2. Related Background Art

For the element member employed for a light-receiving member such as an electrophotographic photosensitive member, there have been proposed various materials such as selenium, cadmium sulfide, zinc oxide, phthalocyanine, amorphous silicon (hereinafter abbreviated as a-Si), etc. Among these materials, non-single-crystal deposited films containing silicon atoms as the main component, as represented by a-Si, for example amorphous deposited films such as a-Si compensated with hydrogen and/or halogen (for example fluorine or chlorine), have been proposed as the photosensitive member of high performance, high durability and no ecological problem, and some deposited films have been practically used. U.S. Pat. No. 4,265,991 discloses an electrophotographic photosensitive member of which a photoconductive layer is mainly composed of a-Si.

The a-Si photosensitive member has a high surface hardness, a high sensitivity to the light of long wavelength region such as of a semiconductor laser (770 nm to 800 nm) and exhibits little deterioration even after repeated use, and is widely employed as the electrophotographic photosensitive member for high-speed copying machines and laser beam printers (LBP).

For forming such deposited films, there have been known various methods such as sputtering, thermal CVD, photo CVD, plasma CVD, etc. Among these methods, the plasma CVD in which a raw material gas is decomposed by glow discharge caused by a DC current, a high frequency (RF, VHF) or a microwave to form a thin deposited film on a substrate such as glass, quartz, a heat-resistant plastic film, stainless steel or aluminum has been particularly advanced, for example, for the formation of an amorphous silicon deposited film for practical use in electrophotography, and various apparatus have also been proposed for executing such formation.

Also in recent years, there have been made various considerations for meeting the increasing demands for an improved film quality and for a higher throughput.

In particular, the plasma process utilizing the high frequency power has been adopted because of various advantages such as stability of discharge and applicability in the formation of insulating films such as an oxide film and a nitride film. Also recently a report on the plasma CVD method employing a high frequency power source of 50 MHz or higher in a plasma CVD apparatus with parallel flat electrodes (Plasma Chemistry and Plasma Processing, Vol. 7, No. 3 (1987), pp. 267–373) has shown a possibility of improving the deposition rate, without deteriorating the properties of the deposited film, by elevating the discharge frequency beyond the conventionally employed frequency of 13.56 MHz. Such elevation in the discharge frequency has also been tried in sputtering processes and is being investigated widely.

In applying the a-Si photosensitive member, produced by such methods, to an image forming apparatus employing so-called electrophotographic technology, a corona charger (corotron or scorotron) is mostly employed as the charging and charge eliminating means for the photosensitive member. Such corona discharge generates ozone ($O_3$) which oxidizes nitrogen in the air to generate corona discharge products such as nitrogen oxides ($NO_x$), and thus generated nitrogen oxides etc. react with the moisture in the air to generate nitric acid or the like. Such corona discharge products, for example nitrogen oxides and nitric acid, are deposited on the photosensitive member and surrounding devices and contaminate the surfaces thereof. As the corona discharge products exhibit a low electrical resistance by moisture absorption, the charge retaining ability is substantially lowered over the entire area or in local areas, leading to image defects such as a faint image or a smeared image (due to deformation or no formation of the electrostatic latent image by the charge on the photosensitive member leaking along the surface thereof).

Also the corona discharge products deposited on the internal surface of a shield plate of the corona charger evaporate and are liberated not only while the image forming apparatus is in operation but also while the apparatus is stopped—for example, during the night. The evaporated products deposit on the surface of the photosensitive member corresponding to the aperture of the corona charger and absorb moisture, whereby the surface of the photosensitive member is reduced in electrical resistance. For this reason, the first copy (output) or several copies at the initial stage when the apparatus is started after a pause tend to show a faint image or a smeared image in an area which is opposed to the aperture of the corona charger while the apparatus is stopped. Such image smear, appearing like the trace of the charger, is often called the charger trace smear. Such defect becomes conspicuous when the corona charger is an AC corona charger.

The faint image and the smeared image induced by the corona discharge products become more serious when the photosensitive member is an a-Si photosensitive member. In comparison with other photosensitive members, the a-Si photosensitive member tends to exhibit a lower efficiency of charging and charge elimination, so that the charging and the charge elimination by corona discharge to the a-Si photosensitive member are conducted with a higher voltage for applying to the charger in order to significantly increase the charging current in comparison with the cases of other photosensitive members. Since the amount of ozone generation is proportional to the corona charging current, a configuration employing an a-Si photosensitive member in combination with a corona charger particularly generates a large amount of ozone, thereby eventually enhancing the faint image and the smeared image resulting from the corona discharge products. Also in the case of the a-Si photosensitive member, due to the adverse effect of the very high surface hardness thereof, the corona discharge products deposited thereon tend to remain firmly for a long time.

For preventing such faint image or smeared image, there have been contemplated the following two methods.

The first method consists of reducing the relative humidity by heating (30° C. to 50° C.) the surface of the photosensitive member by use of a heater incorporated into the photosensitive member or by blowing warm air to the photosensitive member by use of a warm air blower. This method is capable of evaporating the corona discharge products and the moisture deposited on the surface of the photosensitive member, thereby substantially avoiding the reduction in resistance of the photosensitive member surface.

The second method consists of increasing the water repellent property of the surface of the photosensitive member, thereby rendering the deposition of the corona discharge products more difficult and thus preventing the smeared image. For example, the Japanese Patent Application Laid-Open No. 61-289354 discloses an a-C surface layer subjected to plasma treatment with a fluorine-containing gas. Also the Japanese Patent Application Laid-Open No. 60-12554 discloses an electrophotographic photosensitive member having a surface layer composed of an amorphous material containing carbon and halogen atoms, and a producing method therefor. Furthermore, the Japanese Patent Application Laid-Open No. 63-65447 discloses the technology on a fluorine-containing organic polymer film defined by the relationship of an absorption coefficient of infrared absorption spectra, though it is principally intended for use as a charge transporting layer and has not been explained for use as a surface layer.

However, though the first method can solve the drawback of smeared image by the use of a heating device for the photosensitive member, it is preferable not to heat the photosensitive member by such heating device as a drum heater, in consideration of the energy saving and the ecology.

Also, when the a-Si drum of high image quality is adopted in a full-color copying machine and the photosensitive member is thus heated, the possibility of melt-adhesion, i.e., melting of toners to attach to the surface of the photosensitive drum, becomes higher since color toners are low-melting. Furthermore, the image density may locally become higher or lower at the interval of rotation of the cylindrical developer. Such fluctuation in the image density is induced by the expansion of the developer by the heat of the photosensitive member while the apparatus is stopped, and then the distance of the photosensitive member from an opposed portion thereof is reduced, thereby facilitating the transfer of the developer in comparison with the ordinary state. From these facts, there has been desired a photosensitive member which can avoid the faint image or the smeared image without heating.

On the other hand, with respect to the second method utilizing the improvement of the water repellent property, the aforementioned patent application describes the improvement of the water repellent property in case of exposure to ozone, but does not describe whether a durability test by a copying operation using a large number of papers has been practically conducted. The present inventors conducted a confirming test according to the method disclosed in the Japanese Patent Application Laid-Open No. 61-289354 and it proved to be an improvement on the smeared image in the initial period, but still showed smeared image after a continuous copying operation using a large number of papers.

A confirming test was also conducted on the method disclosed in the Japanese Patent Application Laid-Open No. 60-12554.

In this test it was proved that the fluorine-containing amorphous film or the organic polymer film was superior in preventing the smeared image from the initial period in comparison with the conventional surface layers and maintained such performance even after a continuous copying test.

However since the surface layer which is softer than the conventional surface layer gradually abraded by friction with paper and components arranged around the photosensitive member, the surface layer is required to have a higher hardness in order to maintain the performance of the surface layer up to the number of copying papers which is required for the a-Si surface layer with the ordinary thickness. It was also found that when a larger thickness was made larger in consideration of such abrasion, drawbacks such as an increased retentive potential and a lowered sensitivity were generated.

A confirming test was furthermore conducted on the method disclosed in the Japanese Patent Application Laid-Open No. 63-65447. In this prior technology, the physical properties are defined by the values of infrared absorption spectrum, but such definition is given in consideration of the properties for the charge transporting layer, and it proved to be insufficient in specific resistivity and in hardness for use as a surface layer.

In consideration of the foregoing, there is desired a photosensitive member (light-receiving member) provided with a surface layer of highly water-repellent property enough for preventing the faint image and the smeared image without heating, in which the water-repellent property is not deteriorated for a prolonged period, even after a copying operation using a large number of papers.

Also there is desired a technology capable of realizing high image quality in stable manner, in order to meet the recent requirement for the improvement of the copy image quality, in addition to the requirement for solving the drawback of smeared image. More specifically, a higher sensitivity and a thinner structure are requested for the light-receiving member (electrophotographic photosensitive member), in order to meet the various requirements, such as a higher definition, a higher operating speed, introduction of digital technologies, compactization, a lower cost etc. for the image forming apparatus such as the copying machine and the printer.

For meeting such requirements, the surface layer for protecting the surface of the photosensitive member is required to have a lower loss for the incident light and a thinner structure, but a thinner structure is in fact not practical in the conventional material for the surface layer. For this reason there is desired a novel material for the surface layer, having a wide band gap for realizing a low loss to the incident light and a high breakdown voltage, and allowing to form a thin film.

SUMMARY OF THE INVENTION

An object of the present invention is to provide a light-receiving member which can provide a high quality image without faint image or smeared image without employing heating means for the light-receiving member (photosensitive member) under any ambient condition, and which has high durability capable of maintaining such property.

Another object of the present invention is to provide a light-receiving member, without using the heating means, which can prevent the adhesion of low-melting toners such as color toners, and which also prevent the unevenness in the image density resulting at the rotating interval of the developer.

Still another object of the present invention is to provide a light-receiving member which is provided with a high sensitivity, is free from image defects resulting from the charge leaking, and is capable of providing a high quality image in stable manner, without time-dependent change.

Still another object of the present invention is to provide an image forming apparatus comprising a light-receiving member which meets the above-mentioned objects, and an image forming method utilizing such light-receiving member.

Still another object of the present invention is to provide an image forming apparatus which can provide a high quality image without using an additional structural component such as the heating means for the light-receiving member, thereby achieving a lower cost, a compacter size and a lower energy consumption.

Still another object of the present invention is to provide an image forming method capable of expanding the range of selection of the toners, e.g., enabling the use of low-melting toners, and capable of conducting more stable image development and realizing stable image forming cycle.

More specifically, the object of the present invention is to provide a light-receiving member comprising a photoconductive layer provided on an electroconductive substrate, and a surface layer provided on the photoconductive layer, the surface layer comprising non-single-crystal carbon containing at least fluorine, wherein the surface layer has a ratio of the area of a peak having the center in the vicinity of 1200 $cm^{-1}$ or 1120 $cm^{-1}$ in an infrared absorption spectrum to the area of a peak having the center in the vicinity of 2920 $cm^{-1}$ being in a range from 0.1 to 50.

Another object of the present invention is to provide an image forming apparatus comprising: a light-receiving member comprising a photoconductive layer provided on an electroconductive substrate, and a surface layer provided on the photoconductive layer, the surface layer comprising non-single-crystal carbon containing at least fluorine, wherein the surface layer has a ratio of the area of a peak having the center in the vicinity of 1200 $cm^{-1}$ or 1120 $cm^{-1}$ in an infrared absorption spectrum to the area of a peak having the center in the vicinity of 2920 $cm^{-1}$ is within a range from 0.1 to 50; and a charging unit, a developing unit and a cleaner provided in this order around the light-receiving member.

Still another object of the present invention is to provide an image forming method comprising the steps of: charging a light-receiving member comprising a photoconductive layer provided on an electroconductive substrate, and a surface layer provided on the photoconductive layer, the surface layer comprising non-single-crystal carbon containing at least fluorine, wherein the surface layer has a ratio of the area of a peak having the center in the vicinity of 1200 $cm^{-1}$ or 1120 $cm^{-1}$ in an infrared absorption spectrum to the area of a peak having the center in the vicinity of 2920 $cm^{-1}$ is within a range from 0.1 to 50; irradiating a desired area with light to form an electrostatic image; and forming a toner image on the light-receiving member corresponding to the electrostatic image.

DETAILED DESCRIPTION OF THE PREFERRED EMBODIMENTS

Figure 1A:
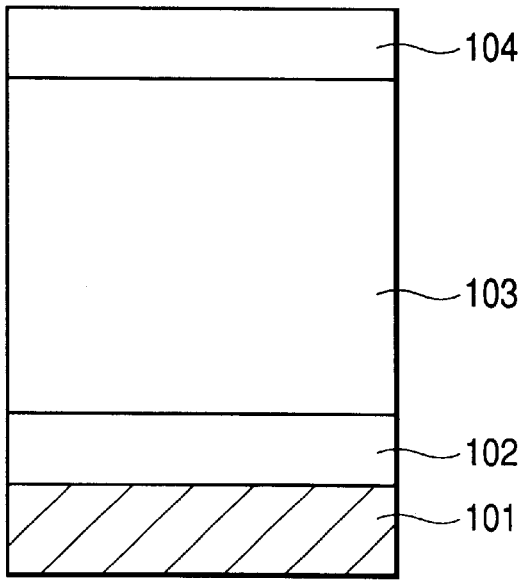
FIGS. 1A and 1B are schematic cross-sectional views showing examples of the preferred layered configuration of the light-receiving member of the present invention.

The above-mentioned configuration of the present invention has been reached from the following investigation.

At first, several kinds of non-single-crystal carbon films containing fluorine were prepared and investigated. (The non-single-crystal carbon film often called diamond-like carbon is neither graphite nor diamond and indicates amorphous carbon exhibiting an intermediate bonded state between graphite and diamond. It may also contain polycrystals or microcrystals instead of being completely amorphous.) As a result of intensive investigation, it was found that a non-single-crystal carbon film formed utilizing the areas of the absorption peaks obtained by the infrared absorption spectroscopy of the film as an index in such a manner that the ratio of areas of specified peaks was within a specified range, could simultaneously satisfy the durability of the water repellent property and the abrasion resistance of the film.

More specifically, the peaks having the center in the vicinity of 1200 $cm^{-1}$ and 1120 $cm^{-1}$ respectively indicate the elongating vibrations of $CF_2$ bond and CF bond, and these peaks have been found effective as an index indicating the difficulty of detachment of bonded fluorine, namely indicating the durability of the water repellent effect. On the other hand, the peak having the center in the vicinity of 2920 $cm^{-1}$ is an absorption band based on the elongating vibration of $sp^3$-bonded CH or the asymmetrical elongating vibration of $CH_2$, and has been found effective as an index indicating the hardness. It has also been found that a film formed in such a manner that a ratio of the area of the peak in the vicinity of 1200 $cm^{-1}$ or 1120 $cm^{-1}$ to the area of the peak in the vicinity of 2920 $cm^{-1}$ is within a range from 0.1 to 50, maintains the water repellent effect even after copying operation using a large number of papers and exhibits a slight amount of abrasion.

It was found that when the ratio of the peak area became less than 0.1, the film exhibited a higher hardness and became less abradable, but resulted in a lower durability of the water repellent effect, thus causing the smeared image after copying operation using a large number of papers. It was also found that when the ratio was higher than 50, the water repellent effect was improved but the film became easily abraded and becomes unable to satisfactorily maintain the function as the surface layer after copying operation using a large number of papers.

In the fluorine-containing non-single-crystal carbon film formed in the range of the present invention, the reason for the improved durability of the water repellent effect and for the reduced tendency of abrasion is not yet fully clarified but is estimated as follows.

The durability of the water repellent effect of such fluorine-containing non-single-crystal carbon film is not necessarily proportional to the absolute amount of fluorine. Thus the durability of the water repellent effect is more strongly influenced by a factor based on the strength of the fluorine bonds on a surface, than by the absolute amount of fluorine. The spectral peaks employed in the present invention indicate the elongating vibrations of $CF_2$ and CF bonds, and are considered to represent fluorine atoms which are incorporated in the network of the film and are bonded in a stable state. On the other hand, the fluorine atoms in other bonded states such as $CF_3$ at the terminal portion of a carbon skeleton, or interlattice $F_2$ or HF molecules, are considered to be relatively easily removed by abrasion, in comparison with fluorine atoms present in the skeleton such as —$CF_2$—. Based on these facts, the water repellent effect is made durable even after copying operation using a large number of papers, in the fluorine-containing non-single-crystal carbon film in which the bonded state of fluorine is defined in the range of the present invention.

Also with respect to the film hardness, as it is also influenced significantly by the bonded state, the effect of the present invention is estimated to be derived from the film defined by the indexes obtained from the infrared absorption spectrum. More specifically, when fluorine atoms are introduced into the non-single-crystal carbon film, the film tends to become a polymer-like film instead of developing a three-dimensional network structure. It is therefore necessary to suppress the amount of fluorine atoms bonded in such positions as to hinder the development of the three-dimensional network, thereby avoiding the loss in strength of the skeleton. For this reason, the absorption peak resulting from a strong skeleton, namely indicating the elongating vibration of $sp^3$-bonded CH, is assumed to have to be present above a certain level in order to maintain the hardness while incorporating fluorine atoms into the network in a stable state. It is therefore presumed, based on these facts, that the hardness and the durability of water repellent effect can be obtained at the same time only when the film is formed with a delicate balance of the peak in the vicinity of 2920 $cm^{-1}$ and that in the vicinity of 1200 $cm^{-1}$ or 1120 $cm^{-1}$ in the infrared absorption spectrum.

In addition, the present invention provides unexpected effects of minimizing a sensitivity loss due to the presence of the surface layer and further reducting in the thickness of the surface layer by the improved breakdown voltage of the film.

These two unexpected effects are presumed as follows. The fluorine-containing non-single-crystal carbon film of the present invention has proved to have a wider band gap in comparison with the conventional amorphous carbon (a-C) film. This is presumably because the C—F bond which is stronger than C—C or C—H bond widens the difference between the bonding energy and antibonding energy, thereby resulting in a widening of the optical band gap. Such widened band gap is presumed to reduce the sensitivity loss and to lead to an improved sensitivity, in comparison with the conventional a-C film, with respect the same thickness.

Also the fluorine-containing non-single-crystal carbon film in general has a low free energy of the film and therefore exhibits good wettability to the surface of the photosensitive member, thereby improving coverage. Further in the range of the present invention, the denseness of the film is significantly improved in addition to good coverage. Such high level of denseness is presumably based on the bonded state of fluorine atoms, but is not yet fully clarified. Good coverage allows to uniformly cover defects formed on the surface of a photoconductive layer, for example caused by spherical projections, and the high denseness prevents the movement of the charge around the defects. Therefore, the breakdown voltage of the film is improved and it is unlikely to generate white spots or the like which are caused by the charge leaking in the surface layer. The present invention has been reached through these investigations.

As described in the foregoing, the surface layer of the present invention is formed in such a manner that a ratio of the area of a peak having a center in the vicinity of 1200 $cm^{-1}$ or 1120 $cm^{-1}$ in the infrared absorption spectrum to the area of a peak having a center in the vicinity of 2920 $cm^{-1}$ is within a range from 0.1 to 50. Such configuration allows to effectively solve the above-described drawbacks.

The photoconductive layer on which the surface layer is to be provided preferably comprises a non-single-crystal material containing silicon as a matrix, and more preferably amorphous silicon containing hydrogen or halogen.

Also in the light-receiving member of the present invention, the non-single-crystal carbon surface layer preferably contains at least hydrogen.

Furthermore, according to the present invention, the surface layer is desirably formed by using a fluorine-substituted hydrocarbon gas as a part of raw material gases and by utilizing a plasuma obtain by the raw material gases, and such fluorine-substituted hydrocarbon gas is preferably a gas obtained by replacing all the hydrogen atoms of a hydrocarbon with fluorine atoms. A preferred example of the fluorine-substituted hydrocarbon gas is $CF_4$ gas.

Furthermore, the surface layer of the present invention is preferably formed by decomposing raw material gases by a plasma CVD method employing a high frequency of 1 to 450 MHz, more preferably 50 to 450 MHz.

Also between the photoconductive layer and the surface layer, there is desirably formed a buffer layer having an intermediate composition of these two layers.

In the following the present invention will be clarified further with reference to the attached drawings.

Figure 1B:
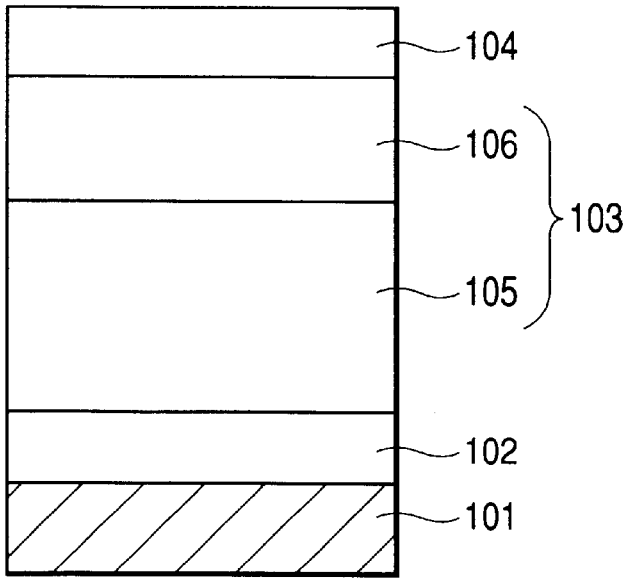

FIGS. 1A and 1B are schematic cross-sectional views showing examples of the configuration of the light-receiving member of the present invention. FIG. 1A shows a photosensitive member called single layer type, in which the function of the photoconductive layer is not separated. The photosensitive member has a multilayered structure comprising a charge injection inhibiting layer 102 which is provided if necessary, a photoconductive layer 103 comprising a-Si containing at least hydrogen, and a surface layer 104 of non-single-crystal carbon containing at least fluorine stacked on a substrate 101 in this order.

FIG. 1B shows a photosensitive member called function separation type, in which the photoconductive layer is separated in function into a charge generating layer and a charge transporting layer. It has a multilayered structure comprising a charge injection inhibiting layer 102 provided if necessary, a photoconductive a-Si layer 103 containing at least hydrogen which is separated in function into a charge transporting layer 105 and a charge generating layer 106, and a surface layer 104 of non-single-crystal carbon containing at least fluorine stacked on a substrate 101 in the order. Either of the charge transporting layer 105 and the charge generating layer 106 may be positioned at the side of the substrate 101, and the order of these layers may be suitably determined according to the desired characteristics and physical properties. Also, when the separation of the functions is achieved by a change in the composition, such change in the composition may be realized by continuous composition change and a single layer is divided into regions which each execute the respective functions. The change of the layer composition in the direction of thickness of the layer may be suitably designed according to the requirement regardless whether the layer is separated in functions or formed into a single layer or plural layers.

Thus, in the photosensitive members shown in FIGS. 1A and 1B, each layer may involve a continuous change in the composition and may lack distinct interfaces. Also the charge injection inhibiting layer 102 may be omitted if unnecessary. Furthermore, an intermediate layer may be provided between the photoconductive layer 103 and the surface layer 104 of non-single-crystal carbon, for example for improving the adhesion. The intermediate layer can be composed, for example, of SiC having an intermediate composition between the compositions of the photoconductive layer 103 and the surface layer 104, but it may also be composed of SiO, SiN or the like. Also the intermediate layer may include continuous change in the composition.

The non-single-crystal carbon mentioned in this specification principally indicates, as explained in the foregoing, amorphous carbon having the intermediate property between graphite and diamond, but it may partially contain microcrystals or polycrystals. Such material can be formed for example by plasma CVD, sputtering or ion plating, but a film formed by plasma CVD exhibits a high transparency and a high hardness and is suitable for use as the surface layer of the light-receiving member such as the electrophotographic photosensitive member.

In the plasma CVD method for producing the non-single-crystal carbon film, there may be employed any discharge frequency as long as the desired plasma can be generated. Industrially there can be advantageously employed a high frequency of frequency band of 1 to 450 MHz, particularly a high frequency of the RF band of 13.56 MHz. Also use of a high frequency of the VHF band of 50 to 450 MHz is more preferable for the production of the surface layer, since both transparency and hardness of the surface layer can be made higher.

For obtaining the effect of the present invention, there can be employed any fluorinated gas that can generate active fluorine radicals by plasma formation, such as $CF_4$, $CHF_3$, $CH_2F_2$, $CH_3F$, $C_2F_6$, $C_2F_4$ or $CH_2CF_2$. Though some gasses can singly form a film, these gasses are preferably used, in general, in combination with a hydrocarbon such as $CH_4$ or hydrogen since the latitude can be increased. It is also possible to form a film by employing a carbon-free fluorine source such as $ClF_3$, $F_2$, $SF_6$ or HF in combination with a hydrocarbon or hydrogen. It is furthermore possible to use a mixture of the above-mentioned gasses or such gasses diluted with another gas such as a rare gas.

Figure 2:
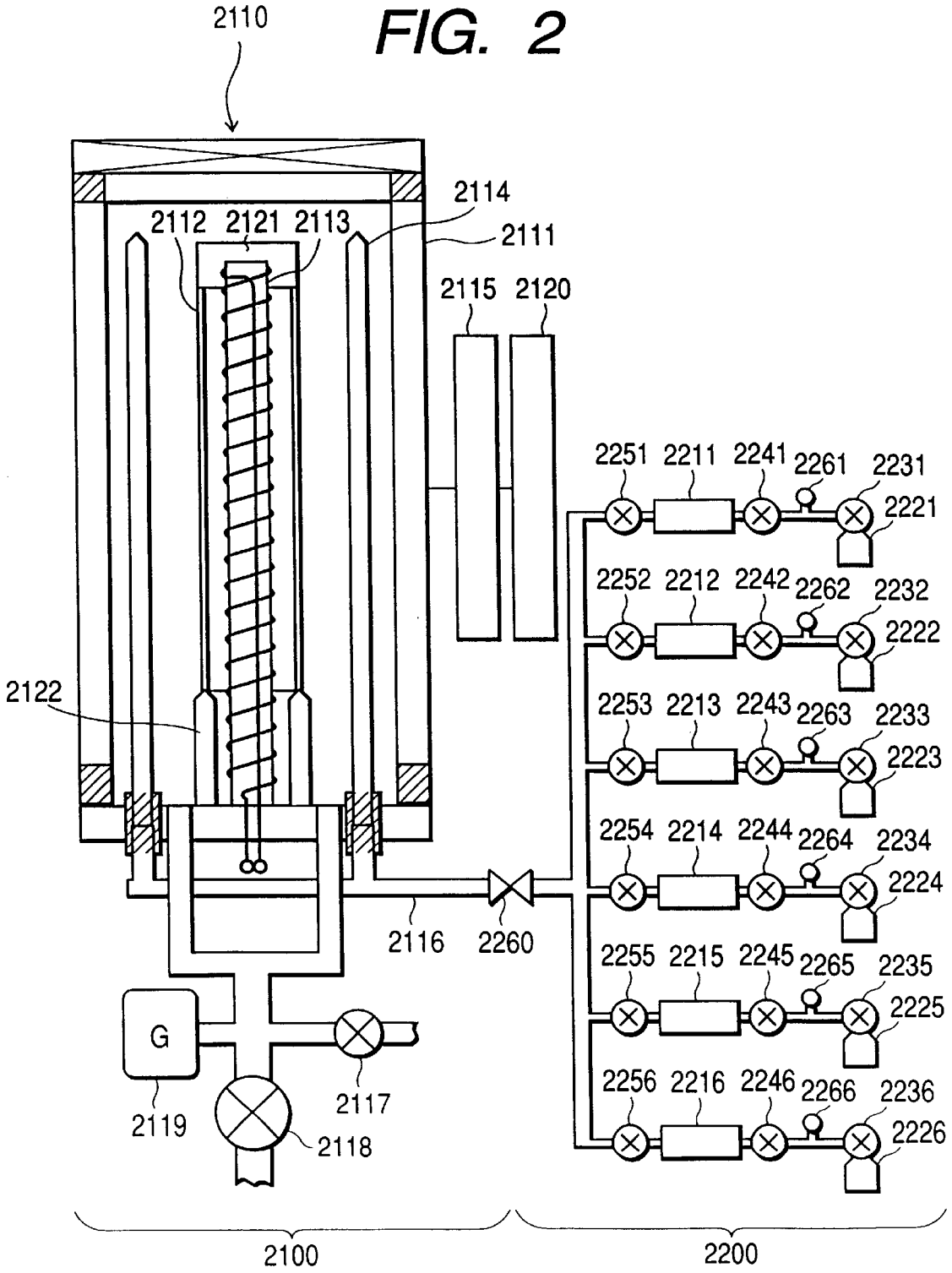
FIGS. 2 and 3 are schematic cross-sectional views showing examples of the producing apparatus advantageously employed for the light-receiving member of the present invention.

FIG. 2 is a schematic view showing the configuration of an example of the deposition apparatus for producing the photosensitive member of the present invention by plasma CVD employing a high frequency power supply.

The apparatus is principally composed of a deposition apparatus 2100 a raw material gas supply apparatus 2200 and a vacuum apparatus (not shown in the drawing) for evacuating the interior of a reaction chamber 2110. In the reaction chamber 2110 of the deposition apparatus 2100, there are provided a grounded cylindrical substrate 2112 on which a film is to be formed, a heater 2113 for the cylindrical substrate, and a raw material gas introducing pipe 2114, and a high frequency power source 2120 is connected via a high frequency matching box 2115 to a cathod 2111. There are also provided substrate holders 2121, 2122.

The raw material gas supply apparatus 2200 is composed of raw material gas containers and etching gas containers 2221 to 2226 such as for $SiH_4$, $H_2$, $CH_4$, NO, $B_2H_6$, $CF_4$ etc., valves 2231 to 2236, 2241 to 2246, 2251 to 2256 and mass flow controllers 2211 to 2216, and these gas containers are connected via a valve 2260 to the gas introducing pipe 2114 in the reaction chamber 2110.

The high frequency power source to be employed in the present invention can have any output electric power suitable for an apparatus to be used in a range of 10 to 5000 W or higher. Also the high frequency power source may have any output fluctuation rate for attaining the effect of the present invention.

Also the matching box 2115 having any configuration may be advantageously employed as long as it can match the high frequency power source 2120 in a load. Automatic matching is advantageous for this purpose, but manual matching can also be employed without influencing the effect of the present invention at all.

A cathode 2111 receiving the high frequency power can be composed, for example, of copper, aluminum, gold, silver, platinum, lead, nickel, cobalt, iron, chromium, molybdenum, titanium, an alloy containing at least one of these elements, stainless steel or a composite material composed of two or more of these materials. The cathod is preferably shaped as a cylindrical shape but also as an oval shape or a polygonal shape if necessary. A cathode 2111 may be provided with cooling means if necessary. The cooling means can be selected for example from water, air, liquid nitrogen and Peltier element according to the requirement.

The cylindrical substrate 2112 on which a film to be formed in the present invention can be formed of a desired material and have a desired shape according to the purpose of use. For example, when an electrophotographic photosensitive member is produced, its shape is desirably cylindrical but may also assume a flat plate-like shape or other shapes according to the requirement. As the material of the substrate, copper, aluminum, gold, silver, platinum, lead, nickel, cobalt, iron, chromium, molybdenum, titanium, stainless steel, or a composite material composed of two or more of the foregoing materials can be used. An insulating material coated with a conductive material can be also used, for example polyester, polyethylene, polycarbonate, cellulose acetate, polypropylene, polyvinyl chloride, polyvinylidene chloride, polystyrene, glass, quartz, ceramics and paper which are coated with a conductive material. The surface may also be subjected to bite polishing or dimple forming for example in order to prevent interference.

In the following there will be explained an example of the method of producing the photosensitive member by the apparatus shown in FIG. 2.

The cylindrical substrate 2112 on which a film is formed is placed in the reaction chamber 2110, and the interior thereof is evacuated by a vacuum apparatus not shown in the drawing (for example, a vacuum pump). Then the cylindrical substrate 2112 is controlled by the substrate heater 2113 is controlled at a desired temperature within a range of 20° C. to 500° C.

In order to introduce raw material gasses for forming a photosensitive member into the reaction chamber 2110, it is at first confirmed that the valves 2231 to 2236 of the gas containers and a leak valve 2117 of the reaction chamber are closed and that inlet valves 2241 to 2246, outlet valves 2251 to 2256 and an auxiliary valve 2260 are opened, and a main valve 2118 is opened to evacuate the interior of the reaction chamber 2110 and the gas supply pipe 2116.

Then the auxiliary valve 2260 and the outlet valves 2251 to 2256 are closed when the indication of a vacuum gauge 2119 reaches $5\times10^{-6}$ Torr. Then the valves 2231 to 2236 are opened to introduce gasses from the gas containers 2221 to 2226, and each pressure of the gases is adjusted to 2 kg/cm$^2$ by pressure controllers 2261 to 2266. Then the inlet valves 2241 to 2246 are gradually opened to introduce the gasses into the mass flow controllers 2211 to 2216.

After the above-described preparation for film formation, a photoconductive layer is formed on the cylindrical substrate 2112.

When the cylindrical substrate 2112 reaches a predetermined temperature, the predetermined valve(s) among the outlet valves 2251 to 2256 and the auxiliary valve 2260 are gradually opened to introduce predetermined raw material gasses from the gas containers 2221 to 2226 into the reaction chamber 2110 through the gas introduction pipe 2114. Then the raw material gasses are controlled at predetermined flow rates by the mass flow controllers 2211 to 2216. Also the aperture of the main valve 2118 is so controlled, under the observation of the vacuum gauge 2119, that the interior of the reaction chamber 2110 is maintained at a predetermined pressure not exceeding 1 Torr. When the internal pressure is stabilized, the high frequency power source 2120 is set at a desired power to supply the power through the high frequency matching box 2115 to the cathode 2111, thereby inducing high frequency glow discharge. The energy of the discharge decomposes the raw material gasses introduced into the reaction chamber 2110, whereby a predetermined deposited film composed of silicon atoms as a main component is formed on the cylindrical substrate 2112. After the formation of a film having a desired thickness, the supply of the high frequency power is stopped, and the outlet valves 2251 to 2256 are closed to interrupt the supply of the raw material gasses into the reaction chamber 2110, whereby the formation of the deposited film is completed.

The surface layer of the present invention can also be formed by supplying the film-forming gasses and starting the discharge similarly to the above-described procedure. The fluorine-containing non-single-crystal carbon film providing the effects of the present invention can only be formed by the appropriate selection of the conditions such as the kind and mixing ratio of gasses to be used, film-forming pressure, high frequency electric power and frequency thereof, and film forming temperature, but can be formed in a conventional plasma CVD apparatus without a special apparatus.

The mixing ratio of the gasses is variable depending on the gas species, but, in general, satisfactory results can be obtained by increasing the amount of dilution with a gas of hydrocarbon or hydrogen for a strongly etching gas and decreasing such amount of dilution for a weakly etching gas. The film-forming pressure can be within the pressure range in the conventional film formation. Though it is variable depending on the gas species, a lower pressure for film formation tends to suppress the polymerization in gaseous phase. As regards the high frequency electric power, a discharge energy above a certain level is supplied to generate the fluorine radicals by dissociating the C—F bonds or the like. On the other hand, an excessive discharge energy is not desirable because the film-forming rate becomes extremely low due to the use of the etching gas. In case of concentric film formation apparatus, a power not exceeding 2000 W is preferred. As regards the frequency, a higher frequency generally provides a film of a higher hardness and a lower loss, but the film thickness becomes uneven when the frequency is excessively high. The film forming temperature can be within the temperature range in the conventional film formation conditions, but an excessively high temperature is not preferred because the band gap tends to become narrower to increase the loss.

As explained in the foregoing, the value set in each condition is not much different from that employed in the conventional film formation, but an appropriate film has not been produced with good reproductivity because the ratio of the peak areas is significantly dependent on the film forming parameters.

In the following there will be explained the film forming procedure in a more specific manner. Necessary ones of the outlet valves 2251 to 2256 and the auxiliary valve 2260 are gradually opened to introduce the raw material gasses required for the surface layer, for example, $CF_4$ gas and $CH_4$ gas, from the gas containers 2221 to 2226 into the reaction chamber 2110 through the gas introduction pipe 2114. Then the gasses are adjusted to predetermined flow rates by the mass flow controllers 2211 to 2216. At the same time the aperture of the main valve 2118 is so adjusted, under the observation of the vacuum gauge 2119, that the interior of the reaction chamber 2110 reaches a predetermined pressure not exceeding 1 Torr. When the internal pressure is stabilized, the high frequency power source 2120 is set to a desired power to supply the power through the high frequency matching box 2115 to the cathode 2111, thereby inducing high frequency glow discharge. The energy of the discharge decomposes the raw material gasses introduced into the reaction chamber 2110, thereby a surface layer. After the formation of a film having a desired thickness, the supply of the high frequency power is stopped, and the outlet valves 2251 to 2256 are closed to interrupt the supply of the raw material gasses into the reaction chamber 2110, whereby the formation of the surface layer is completed.

During the film formation, the cylindrical substrate 2112 may be rotated at a predetermined speed by a driving device (not shown in the drawing). When a still higher hardness is required in the film, a DC bias voltage may be supplied to the high frequency power by an low-pass filter not shown in the drawing.

Figure 3:
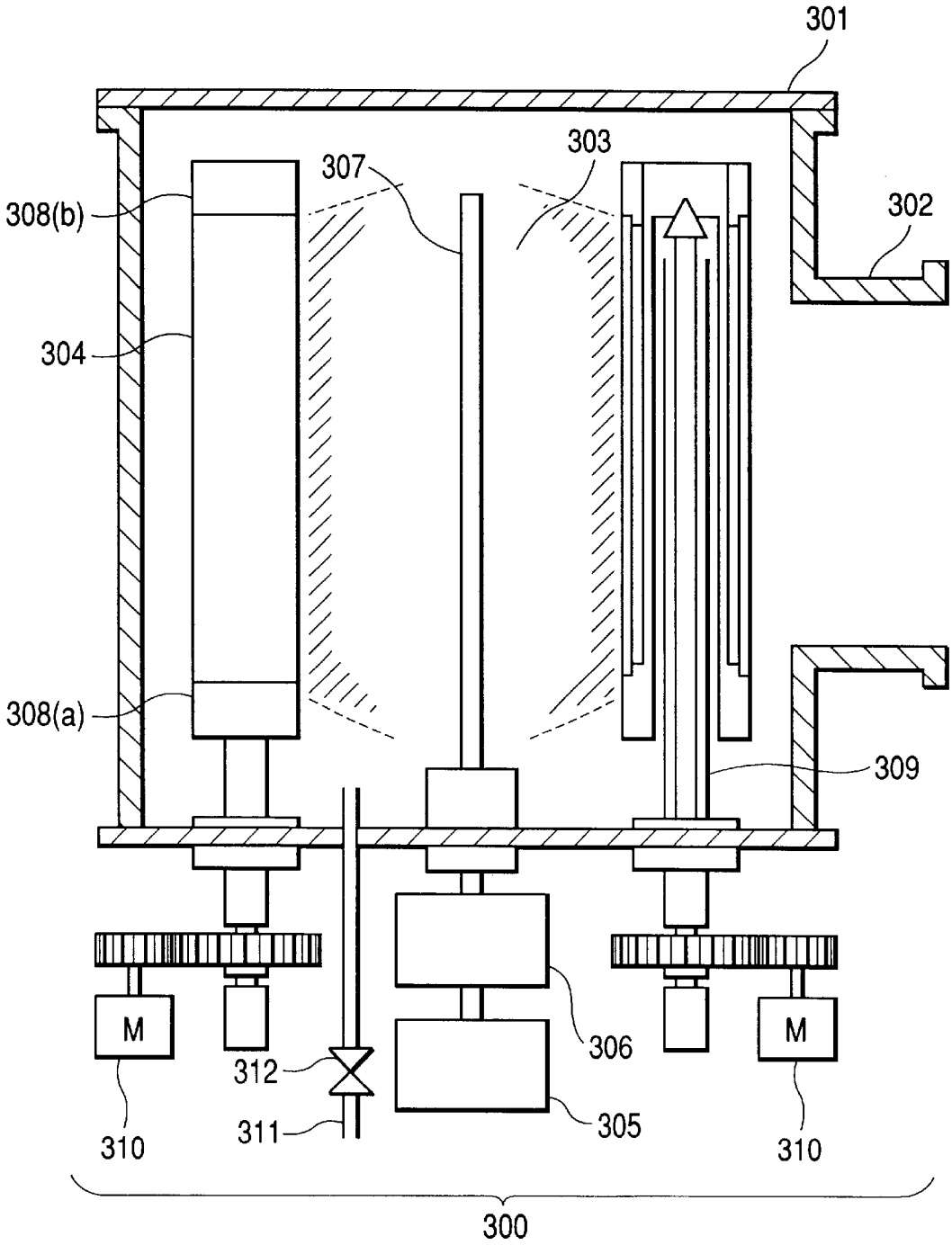

FIG. 3 is a schematic view showing an example of the apparatus (of mass production type) for producing a light-receiving member by a plasma CVD method, which is different from that shown in FIG. 2. Specifically, FIG. 3 shows the schematic cross-sectional view for showing a reaction chamber section.

In FIG. 3, there are shown a reaction chamber 301 of a hermetically sealed structure; an exhaust pipe 302 having one end thereof opened in the reaction chamber 301 and the other end connected to a vacuum apparatus (not shown in the drawing); a discharge space 303 surrounded by cylindrical substrates 304 on which a film is to be formed; and a high frequency power source 305 connected electrically to an electrode 307 via a high frequency matching box 306. The cylindrical substrate 304 is placed on a rotary shaft 309 in a state set on holders 308*a* and 308*b*, and may be rotated by a motor 310 if necessary.

The raw material gas supply apparatus (not shown in the drawing) can be similar to the apparatus 2200 shown in FIG. 2. The raw material gasses are mixed and supplied, through a valve 312, to a gas introducing pipe 311 in the reaction chamber 301.

The high frequency power source to be employed in the present film forming apparatus can have any output electric power suitable for an apparatus to be used in a range of 10 to 5000 W or higher.

Also the high frequency power source may have any output fluctuation rate for attaining the effect of the present invention.

Also the matching box 306 of any configuration may be advantageously employed as long as it can match the high frequency power source 305 in a load. Automatic matching is advantageous for this purpose, but manual matching can also be employed without influencing the effect of the present invention at all.

An electrode 307 receiving the high frequency power can be composed of the same material as that constituting the cathode shown in FIG. 2. Also its shape is the same or can be further adjustable if necessary. The electrode 307 may be provided with cooling means if necessary, similarly to the cathode shown in FIG. 2.

Also the cylindrical substrate 304 on which a film is to be formed is the same as the substrate 2112 of FIG. 2 as explained in relation to FIG. 2.

Figure 4:
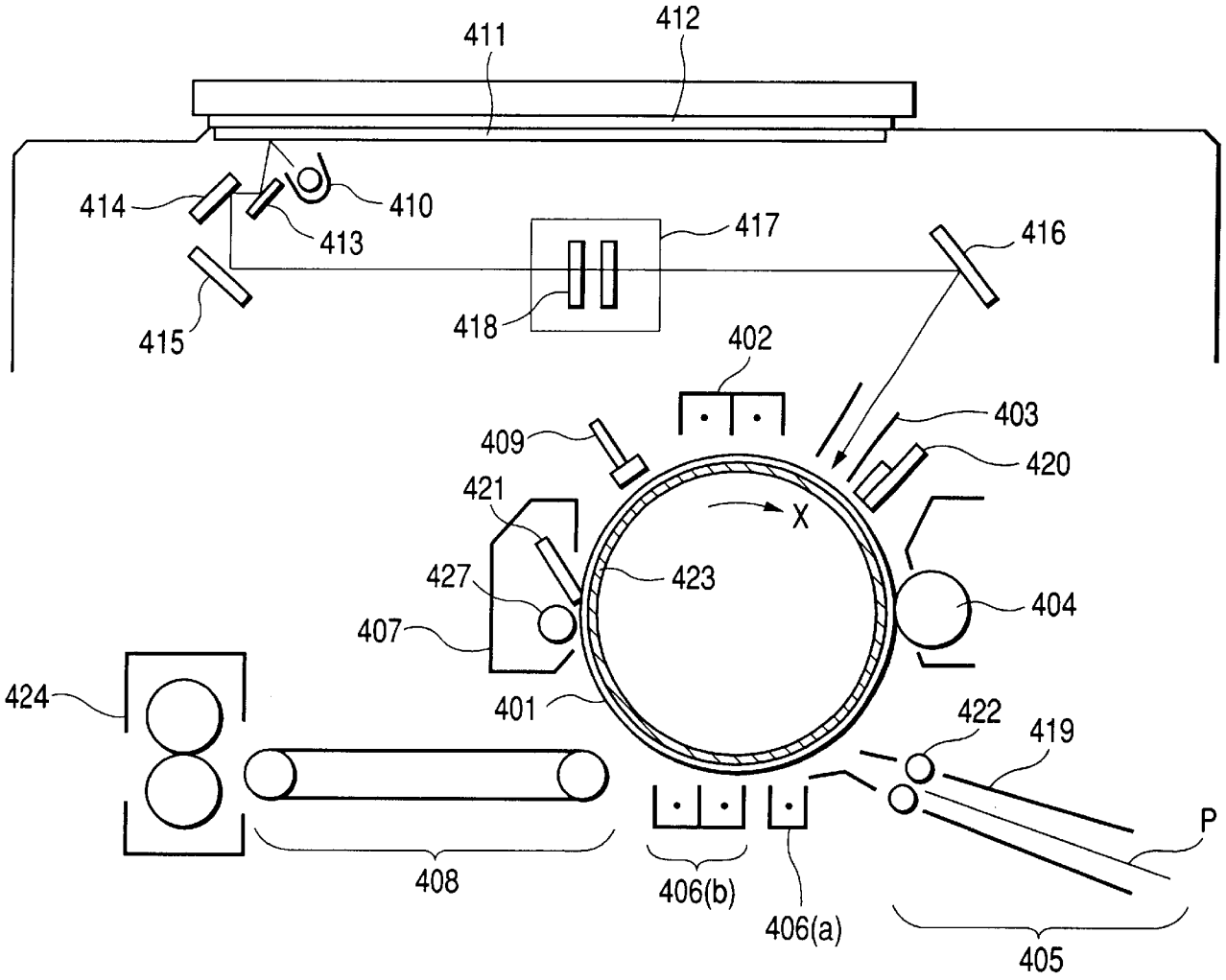
FIG. 4 is a schematic cross-sectional view showing a preferred example of the image forming apparatus provided with the light-receiving member of the present invention.

FIG. 4 is a schematic view showing an example of the configuration of an electrophotographic apparatus, wherein a photosensitive member 401 rotates in a direction of an arrow X. Along the periphery of the photosensitive member 401, there are provided a main charging unit 402, an electrostatic latent image forming portion 403, a developing unit 404, a transfer sheet (transfer material) supply system 405, a transfer charging unit 406(*a*), a separation charging unit 406(*b*), a cleaner 407, a conveyor system 408, a charge eliminating light source 409, a blank exposure light source 420, etc.

In the following there will be given a detailed explanation on the image forming process. The photosensitive member 401 is uniformly charged by the main charging unit 402 receiving a high voltage. The light emitted from a lamp 410 is reflected on an original 412 placed on an original supporting glass 411, then guided by mirrors 413, 414, 415, focused by a lens 418 of a lens unit 417, further guided by a mirror 416 and projected onto the charged surface of the photosensitive member 401, thereby forming an electrostatic latent image thereon. The projected light may also be a light from a laser or an LED, bearing image information over the surface. Negatively charged toner is supplied to the latent image from the developing unit 404 to form a toner image.

On the other hand, a transfer material P, supplied toward the photosensitive member 401 through the transfer sheet supply system 405 under the adjustment of timing of the front end by registration rollers 422, is given a positive electric field, which is opposite in polarity to the toner, from the rear surface in the gap between the transfer charging unit 406(*a*) receiving a high voltage and the photosensitive member 401, whereby the negatively charged toner image on the surface of the photosensitive member is transferred onto the transfer material P. Then by the function of the separation charging unit 406(*b*) receiving a high AC voltage, the transfer material P is separated and transported through the conveyor system 408 to a fixing device 424, in which the toner image is fixed. Then the transfer material P is conveyed from the apparatus to the outside.

The toner remaining on the photosensitive member 401 is recovered by a magnet roller 427 of a cleaning unit 407 and a cleaning blade 421 maintained in contact with the photosensitive member 401, and the remaining charge is eliminated by the charge eliminating light source 409.

In the following there will be explained a method for determining the area ratio in the present invention.

Figure 5:
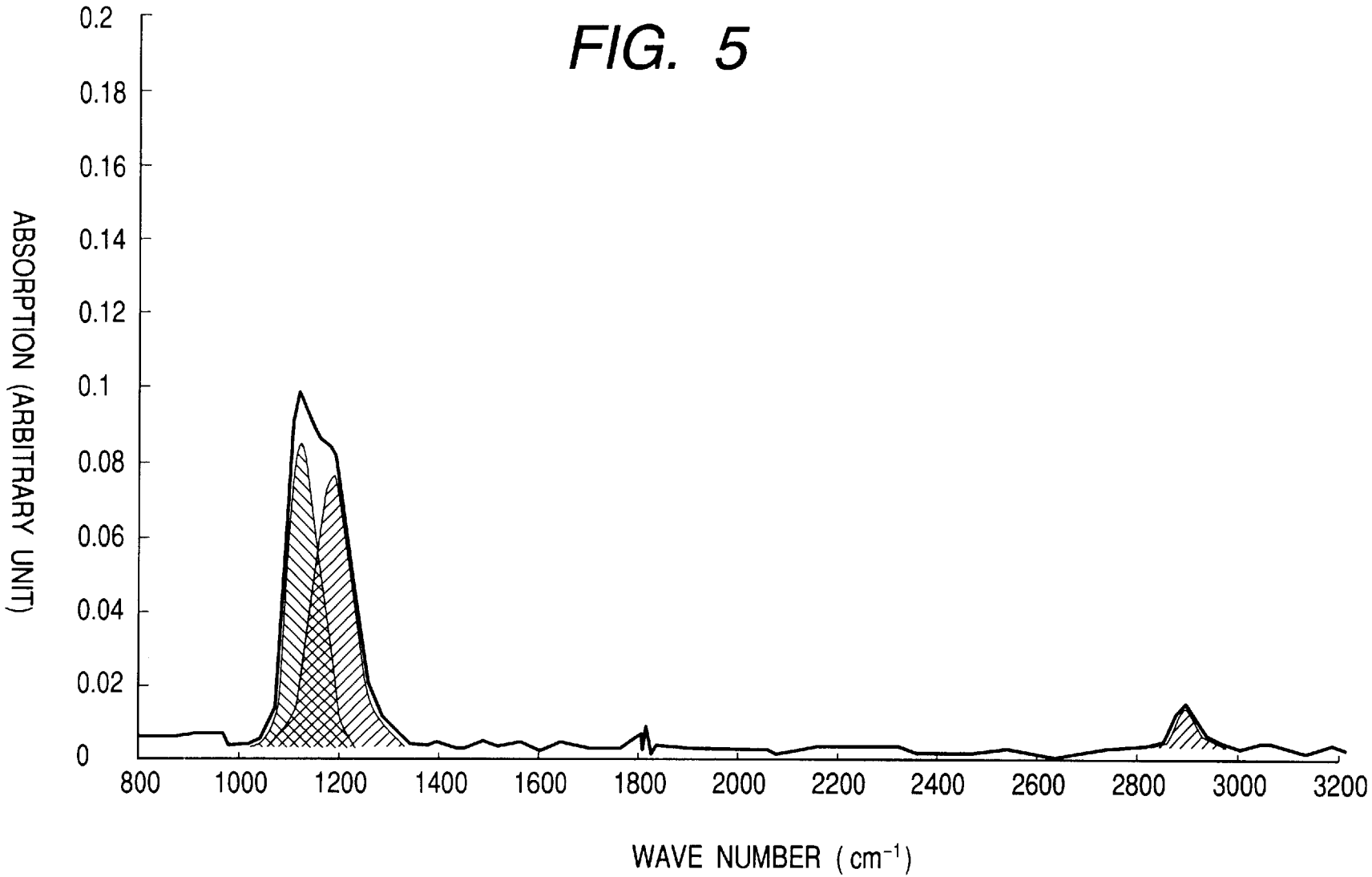
FIG. 5 is a schematic infrared absorption spectrum chart showing a preferred example of the method for determining the area ratio according to the present invention.

FIG. 5 shows an example of the infrared (IR) absorption spectrum, which has peaks having the respective centers in the vicinity of 1120 $cm^{-1}$, 1200 $cm^{-1}$ and 2920 $cm^{-1}$. The spectrum shown in FIG. 5 has a wave form corresponding to the synthesis of a wave form having the center at about 1120 $cm^{-1}$ and another wave having the center at about 1200 $cm^{-1}$. Thus the entire spectrum shows a large peak portion composed of wave forms having the centers in the vicinity of 1120 $cm^{-1}$ and 1200 $cm^{-1}$, and a small peak portion composed of a wave form having the center in the vicinity of 2920 $cm^{-1}$.

The area of a peak having the center at a specified wave number can be determined in the following manner. In the case of a wave form composed of a single peak having the center at a wave number, for example, the peak having the center in the vicinity of 2920 $cm^{-1}$ shown in FIG. 5, a Gaussian distribution curve having the vertex in the vicinity of 2920 $cm^{-1}$ is fitted to the IR absorption wave form, and the area of a portion surrounded by such Gaussian distribution curve and the base line (which is indicated by a hatched area in FIG. 5) is determined.

In the case of the IR absorption wave form composed of synthesis of two wave forms, it is approximated by a wave form obtained by synthesizing two Gaussian distribution curves. More specifically, in the example shown in FIG. 5, a Gaussian distribution curve having the vertex in the vicinity of 1120 $cm^{-1}$ and another Gaussian distribution curve having the vertex in the vicinity of 1200 $cm^{-1}$ determined such that both curves are used to obtain a synthesized Gaussian distribution curve closest to the IR absorption spectrum. Then there are respectively calculated an area surrounded by the Gaussian distribution curve having the vertex in the vicinity of 1120 $cm^{-1}$ and the base line, and an area surrounded by the Gaussian distribution curve having the vertex in the vicinity of 1200 $cm^{-1}$ and the base line.

In the present invention, thus calculated areas can be utilized to determine the ratio of the area corresponding to 1120 $cm^{-1}$ or the area corresponding to 1200 $cm^{-1}$ and the area corresponding to 2920 $cm^{-1}$.

In the case of the spectrum not having a synthesized wave form as shown in the left-hand side of FIG. 5, the Gaussian fitting is no longer necessary and there can be simply calculated the area surrounded by the IR absorption wave form and the base line.

In the following there will be explained preferred examples of the present invention, but it is to be understood that the present invention is by no means limited by such examples.

EXAMPLE 1

The plasma CVD apparatus shown in FIG. 2 was employed to deposit, on a cylindrical Al substrate, a lower inhibition layer and a photoconductive layer under the conditions shown in Table 1, and then a surface layer under the conditions shown in Table 2, in this order, thereby completing a photosensitive member (drum). In this operation, the $CF_4$ flow rate was varied in five levels in a range of 20 to 100 sccm as shown in Table 4 while the high frequency power was varied in three levels within a range of 800 to 1200 W to obtain five photosensitive members. The measurements on the samples produced in advance confirmed that, within the above-mentioned ranges of $CF_4$ flow rate and the high frequency power, the ratio of the peak area of 1120 $cm^{-1}$/2920 $cm^{-1}$ was within a range from 0.14 to 47.8 while the peak ratio of the peak area of 1200 $cm^{-1}$/2920 $cm^{-1}$ was within a range from 0.31 to 48.3.

In order to evaluate the abrasion resistance of the five drums produced in the above-described manner, each drum was rotated at a process speed of 450 mm/sec, and a SiC polishing tape of an average particle size of 8 $\mu$m (LT-C2000 produced by Fuji Film Co., Ltd.) was maintained in contact and was pressed with parallel pins of 3 $\phi$, a width of 20 mm, thereby effecting polishing under a load. The polishing tape was constantly fed with a speed of about 1 mm/sec, thereby always supplying a new polishing surface, thus maintaining a constant polishing power and avoiding the influence of polishing debris. Such forced abrasion was conducted for 60 minutes and the difference in film thickness before and after the polishing test was measured with an optical film thickness meter. The change in film thickness is indicated by a relative amount to the abrasion amount of the SiC surface layer.

The characteristics obtained in the above-described evaluation tests are summarized in Table 4.

TABLE 1

| Conditions for producing photosensitive member (lower inhibition layer and photoconductive layer) | |
|---|---|
| Lower inhibition layer | |
| $SiH_4$ | 260 sccm |
| $H_2$ | 500 sccm |
| NO | 7 sccm |
| $B_2H_6$ | 2100 ppm |
| Power | 110 W |
| Internal pressure | 0.43 Torr |
| Film thickness | 1.5 μm |
| Photoconductive layer | |
| $SiH_4$ | 510 sccm |
| $H_2$ | 450 sccm |
| $B_2H_6$ | 10 ppm (with respect to $SiH_4$) |
| Power | 450 W |
| Internal pressure | 0.55 Torr |
| Film thickness | 20 μm |

TABLE 2

| Conditions for producing surface layer | |
|---|---|
| $CH_4$ | 100 sccm |
| $CF_4$ | variable (20–100 sccm) |
| Power | variable (800–1200 W) |
| Frequency | 13.56 MHz |
| Internal pressure | 0.4 Torr |
| Film thickness | 0.1 μm |

TABLE 3

| Conditions for producing surface layer (Example 2, Comparative Example 2) | |
|---|---|
| $CH_4$ | 100 sccm |
| $CF_4$ | variable (20–100 sccm) |
| Power | variable (400–800 W) |
| Frequency | 105 MHz |
| Internal pressure | 2 mTorr |
| Film thickness | 0.1 μm |

TABLE 4

Results of evaluation of abrasion (Example 1, Comparative Example 1 produced at 13.56 MHz)

| | $CH_4$ flow rate (sccm) | $CF_4$ flow rate (sccm) | Power (W) | IR peak ratio 1120 $cm^{-1}$ / 2920 $cm^{-1}$ | IR peak ratio 1200 $cm^{-1}$ / 2920 $cm^{-1}$ | Abrasion amount (relative amount) |
|---|---|---|---|---|---|---|
| Ex. 1 | 100 | 40 | 800 | 7.4 | 9.1 | AA |
| | 100 | 80 | 1000 | 25.6 | 34.8 | A |
| | 100 | 20 | 1200 | 0.15 | 0.31 | AA |
| | 100 | 60 | 1200 | 10.2 | 12.3 | A |
| | 100 | 100 | 1200 | 47.8 | 48.3 | B |
| Comp. Ex. 1 | 100 | 100 | 800 | 53.6 | 89.1 | C |

AA: no abrasion observed
A: very little abrasion
B: comparable to SiC surface layer
C: all surface layer abraded Comparative Example 1

The plasma CVD apparatus shown in FIG. 2 was employed to deposit, on a cylindrical Al substrate, a lower inhibition layer and a photoconductive layer under the conditions shown in Table 1, and then a surface layer under the conditions shown in Table 2, in this order. In this operation, the surface layer was produced with a $CF_4$ flow rate of 100 sccm and a high frequency power of 800 W as shown in Table 4. The surface layer showed respective peak ratios of 53.6 and 89.1.

There were conducted evaluations similar to those in the Example 1, and the results of evaluations are summarized in Table 4 together with those of Example 1.

In Example 1 conducted within the range of the present invention, the amount of abrasion is smaller than or comparable to that in the SiC surface layer. The SiC surface layer is scarcely abraded by copying operation using the number of papers required for the a-Si photosensitive member, but the abrasion was observed because of a harsh evaluating condition for clarifying the difference. On the other hand, in Comparative Example 1 which is outside the range of the present invention, the surface layer showed a larger abrasion than in the SiC surface layer and was almost abraded off. In this case a considerable abrasion is anticipated in the actual copying conditions, resulting in a practical problem. These results indicate that the area ratio of the peak at 1120 $cm^{-1}$ or 1200 $cm^{-1}$ to the peak at 2920 $cm^{-1}$ should not exceed 50.

EXAMPLE 2

The plasma CVD apparatus shown in FIG. 2 was employed to deposit, on a cylindrical Al substrate, a lower inhibition layer and a photoconductive layer under the conditions shown in Table 1, and then the plasma CVD apparatus shown in FIG. 3 employed to deposit a surface layer under the conditions shown in Table 3, in this order. In this operation, the $CF_4$ flow rate was varied in five levels in a range of 20 to 100 sccm as shown in Table 5 while the high frequency power was varied in three levels within a range of 800 to 1200 W to obtain five photosensitive members. The measurements on the samples produced in advance confirmed that, within the above-mentioned ranges of $CF_4$ flow rate and the high frequency power, the ratio of the peak area of 1120 $cm^{-1}$/2920 $cm^{-1}$ was within a range from 0.17 to 46.7 while the ratio of the peak area of 1200 $cm^{-1}$/2920 $cm^{-1}$ was within a range from 0.22 to 47.5.

In order to evaluate the durability of water repellent effect of the five drums produced in the above-described manner, each drum was subjected to the polishing test as in Example 1, and the amount of fluorine was measured before and after the polishing test to determine the remaining ratio of fluorine with respect to the initial amount. The amount of fluorine was measured by X-ray photoelectron spectroscopy (XPS) in an area very close to the surface (about 50 Å). Also the water repellent property before and after the polishing was evaluated by the contact angle with deionized water, measured by a contact angle meter (CA-S-roll type, produced by Kyowa Kaimen Kagaku Co.). Also for confirming the effect of fluorine remaining after the polishing test, the photosensitive member after the polishing test was mounted on a Canon NP-5060 copying machine modified for experimental purpose, and was subjected to idle rotation of an amount corresponding to 20,000 A4-sized sheets under a high-temperature high-humidity atmosphere of 32° C. and 88% without any heating means such as a drum heater such that the ozone products could sufficiently reach the surface. Then the photosensitive member was left standing for 3 hours in the same high-temperature and high-humidity atmosphere while the copying machine is stopped. Thereafter, generation of the smeared image was evaluated by copying a Canon test chart (part number FY9-9058) and judging line-and-space patterns and contours of characters on the chart.

The results of these evaluations are summarized in Table 5.

TABLE 5

| | Fluorine before and after polishing (Example 2, Comparative Example 2 produced with 105 MHZ) | | | | | | |
|---|---|---|---|---|---|---|---|
| | $CH_4$ flow rate (sccm) | $CF_4$ flow rate (sccm) | Power (W) | Contact angle(°) before polish | Contact angle(°) after polish | Image smear under high temp/humidity | Remaining fluorine ratio after/before polishing |
| Ex.1 | 100 | 40 | 400 | 105 | 95 | AA | 84.1% |
| | 100 | 80 | 600 | 105 | 100 | AA | 90.3% |
| | 100 | 20 | 800 | 100 | 85 | A | 69.2% |
| | 100 | 60 | 800 | 105 | 100 | AA | 88.7% |
| | 100 | 100 | 800 | 105 | 105 | AA | 95.2% |
| Comp. Ex. 1 | 100 | 20 | 800 | 95 | 35 | C | 41.3% |

AA: very excellent image
A: good image
B: slight image smear (practically acceptable)
C: image smear present (practically not acceptable)

Comparative Example 2

The plasma CVD apparatus shown in FIG. 2 was employed to deposit, on a cylindrical Al substrate, a lower inhibition layer and a photoconductive layer under the conditions shown in Table 1, and then the plasma CVD apparatus shown in FIG. 3 was employed to deposit a surface layer under the conditions shown in Table 3, in this order. In this operation, the surface layer was produced with a $CF_4$ flow rate of 20 sccm and a high frequency power of 800 W as shown in Table 5. The measurements on the samples produced in advance confirmed that, in this operation, the ratio of the peak area of 1120 $cm^{-1}$/2920 $cm^{-1}$ was 0.04 while the ratio of the peak area of 1200 $cm^{-1}$/2920 $cm^{-1}$ was 0.07.

The photosensitive drum produced in this manner was evaluated in the same manner as in Example 2.

The obtained results of evaluation are summarized, together with those of Example 2, in Table 5.

In Example 2 which is within the range of the present invention, the fluorine mount before the polishing remained by about 80% or more after the polishing, and the contact angle was 80° or more after the polishing. A test under a high temperature and a high humidity after the polishing proved absence of the smeared image. On the other hand, in Comparative Example 2 which is outside the range of the present invention, the fluorine amount remaining after the polishing decreased to about 40% of that before the polishing, and the contact angle decreased also to about 35°. In this case the contact angle is considered to have been reduced by the decrease of the surface concentration of fluorine by polishing, in addition to the low fluorine amount even at the initial stage. As will be anticipated from such reduced contact angle, the test under a high temperature and a high humidity showed presence of the smeared image.

The decrease of the fluorine amount in Comparative Example 2 is presumed to have resulted from a fact that though the surface was scarcely abraded because of the hard skeleton structure, the fluorine atoms in the vicinity of the surface were mostly present in a stable form such as $CF_3$ radicals and were detached by the abrasion.

Example 2 and Comparative Example 2 indicate that the ratio of the peak area at 1120 $cm^{-1}$ or 1200 $cm^{-1}$ to the peak area at 2920 $cm^{-1}$ should be at least equal to 0.1.

EXAMPLE 3

The plasma CVD apparatus shown in FIG. 2 was employed to deposit, on a cylindrical Al substrate, a lower inhibition layer and a photoconductive layer in this order under the conditions shown in Table 1, and six photosensitive members were produced in this manner. Then a surface layer was produced thereon in the plasma CVD apparatus shown in FIG. 2 by using six fluorine-containing gasses $CF_4$, $CHF_3$, $C_2F_6$, $CF_2{=}CF_2$, $ClF_3$ and $SF_6$, under the conditions shown in Table 6. The measurements on the samples produced in advance confirmed that, in this operation, the ratio of the peak area of 1120 $cm^{-1}$/2920 $cm^{-1}$ and the ratio of the peak area of 1200 $cm^{-1}$/2920 $cm^{-1}$ were both in a range of 10 to 30.

Then each of the photosensitive members was subjected to the evaluation of change in the film thickness by a polishing test, evaluation of image smear under a high temperature and a high humidity after the polishing, and determination of the fluorine amount after the polishing by XPS, similarly to Examples 1 and 2.

The results of the evaluations are summarized in Table 7. These results indicate that the effect of the present invention can be obtained regardless of the kind of the fluorine-containing gas employed in the production of the surface layer.

TABLE 6

| Conditions for producing surface layer (Example 3) | |
|---|---|
| $CH_4$ | 100 sccm |
| Fluorine-containing gas | variable |
| Power | variable (800 to 1200 W) |
| Frequency | 13.56 MHz |
| Internal pressure | 0.4 Torr |
| Film thickness | 0.1 $\mu$m |

TABLE 7

Comparison by different fluorine-containing gasses (Example 3)

| F-containing gas | Flow rate (sccm) | $CH_4$ flow rate (sccm) | High freq. power (W) | Abrasion amount (ratio to SiC) | Image smear at high temp/high humidity | Remaining F after/before polish |
|---|---|---|---|---|---|---|
| $CF_4$ | 60 | 100 | 1000 | AA | AA | 87.1% |
| $CHF_3$ | 60 | 100 | 800 | AA | AA | 91.3% |
| $C_2F_6$ | 20 | 100 | 800 | A | AA | 94.7% |
| $CF_2{=}CF_2$ | 20 | 100 | 800 | A | AA | 95.4% |
| $ClF_3$ | 5 | 100 | 800 | B | AA | 96.2% |
| $SF_6$ | 10 | 100 | 1000 | A | AA | 93.2% |

AA: very excellent
A: conventional level
B: practically acceptable

EXAMPLE 4

The plasma CVD apparatus shown in FIG. 2 was employed to deposit, on a cylindrical Al substrate, a lower inhibition layer and a photoconductive layer under the conditions shown in Table 1, and a surface layer under the conditions shown in Table 2. The surface layer was further produced thereon with a $CF_4$ gas flow rate of 60 sccm and a high frequency power of 1000 W. The measurements on the samples produced in advance confirmed that, with these $CF_4$ flow rate and high frequency power, the ratio of the peak area of 1120 $cm^{-1}$/2920 $cm^{-1}$ was 12.5 and the ratio of the peak area of 1200 cm $^{1}$/2920 $cm^{-1}$ was 14.7.

The sensitivity of the photosensitive drum was measured with an exclusive drum testing machine of a layout similar to that of the copying machine. The drum was rotated at a process speed of 400 mm/sec, and the surface of the drum was charged to a potential of about 400 V by a corona charging unit. Then the light amount was varied at the exposing position, and the surface potential was measured at the developing position. The sensitivity was defined as an exposure amount which provided a surface potential of 50 V. The sensitivity was evaluated by the comparison with the SiC surface layer.

Also in order to evaluate the difference in the breakdown voltage, the NP5060 copying machine was modified by removing the grid of the corona charging unit and selecting the charging potential higher than in the normal condition, thereby creating a situation easily causing charge leaking. Copying operations were conducted with such modified machine, and the image defects (white spots) of partly white image resulting from the charge leaking were counted by comparing the initial image and the image after 1000 sheets copying operation. The result was evaluated by the comparison with the count of white spots obtained in a similar test with the SiC surface layer.

The results of evaluation of the sensitivity and the image defects resulting from charge leaking are summarized in Table 8.

Comparative Example 3

The plasma CVD apparatus shown in FIG. 2 was employed to deposit, on a cylindrical Al substrate, a lower inhibition layer and a photoconductive layer under the conditions shown in Table 1, and a surface layer under the conditions shown in Table 2. The surface layer was further produced thereon with a $CF_4$ gas flow rate of 10 sccm and a high frequency power of 1200 W. The measurements on the samples produced in advance confirmed that, with these $CF_4$ flow rate and high frequency power, the ratio of the peak area of 1120 $cm^{-1}$/2920 $cm^{-1}$ was 0.04 and the ratio of the peak area of 1200 $cm^{-1}$/2920 $cm^{-1}$ was 0.07.

The photosensitive member was then evaluated in the same manner as in Example 4.

The obtained results of evaluation are summarized in Table 8, together with those of Example 4.

The results of Example 4 and Comparative Example 3 indicate that the non-single-crystal carbon film with a peak area ratio smaller than 0.1 exhibits a lowered sensitivity in comparison with the SiC surface layer, but the non-single-crystal carbon film with a peak area ratio in a range from 0.1 to 50 exhibits a sensitivity loss suppressed in a level comparable to that of the conventional surface layer. This is in fact an unexpected effect and is presumed to result from a fact that the fluorine bonds in the film expand the band gap, thereby decreasing the loss at the surface layer.

Also in the breakdown voltage test, Comparative Example 3 which is outside the range of the present invention showed image defects in the form of white spots, though the performance was somewhat improved in comparison with the conventional surface layer. In contrast, Example 4 which is within the range of the present invention showed very little white spots. In the observation of the photosensitive drums under a microscope after the test, Comparative Example 3 showed a large number of traces of leaks from the edge portions of spherical projections, while Example 4 scarcely showed such traces of leaks in the peripheries of the spherical projections. These results indicate that the fluorine-containing non-single-crystal carbon film of the present invention is improved in the breakdown voltage of the film.

TABLE 8

Evaluation of sensitivity and breakdown voltage (Example 4, Comparative Example 3)

| | $CH_4$ flow rate (sccm) | $CF_4$ flow rate (sccm) | High freq. power (W) | Sensitivity (ratio to conventional layer) | Breakdown voltage (ratio to conv. Layer) |
|---|---|---|---|---|---|
| Ex. 4 | 100 | 60 | 1000 | A | AA |
| Comp. Ex. 3 | 100 | 10 | 1200 | B | A |

AA: very excellent
A: conventional level
B: practically acceptable

EXAMPLE 5

The plasma CVD apparatus shown in FIG. 2 was employed to deposit, on a cylindrical Al substrate, a lower inhibition layer and a photoconductive layer under the conditions shown in Table 1, and a surface layer under the conditions shown in Table 2. The surface layer was further produced thereon with a $CF_4$ gas flow rate of 60 sccm and a high frequency power of 1000 W. The measurements on the samples produced in advance confirmed that, with these $CF_4$ flow rate and high frequency power, the ratio of the peak area of 1120 $cm^{-1}$/2920 $cm^{-1}$ was 12.5 and the ratio of the peak area of 1200 $cm^{-1}$/2920 $cm^{-1}$ was 14.7.

The obtained photosensitive member was mounted on a modified NP5060 copying machine and a copy was obtained from a Canon test chart (part number FY9-9058), placed on the original table, with an ordinary exposure amount. The obtained image was inspected for the reproducibility of lines, reproducibility of halftone area and image defects. Also the charging ability and the retentive potential were measured by placing a sensor at the position of the developing unit.

The obtained results are shown in Table 9. The obtained image is clear and showing good reproducibility of halftone and was very satisfactory. Also the charging ability and the retentive potential were satisfactory. These results confirmed that the photosensitive member of the present invention could provide a good image.

TABLE 9

| | Evaluation of image, charging ability and retentive potential | | |
|---|---|---|---|
| | Image | Charging ability | Retentive potential |
| Ex. 5 | AA | AA | AA |

AA: very excellent
A: conventional level
B: practically acceptable

As explained in the foregoing, the present invention can provide a photosensitive member excellent in water repellent property and capable of provide a high-quality image without heating means under a condition of high temperature and high humidity, by forming a surface layer provided on a conductive substrate so as to have a ratio of the area of the peak having the center in the vicinity of 1200 $cm^{-1}$ or 1120 $cm^{-1}$ in the infrared absorption spectrum to the area of the peak having the center in the vicinity of 2920 $cm^{-1}$ within a range from 0.1 to 50. Also by the above-mentioned formation, the present invention can provide a light-receiving member which prevents the deposition of the products of corona discharge, which also prevents the adhesion of low-melting toners such as color toners by melting or the uneven image density resulting at the rotating interval of the developer because the heating means can be omitted, and which has a high sensitivity without generation of image defects resulting from the leak of surface charge, thereby stably providing a high-quality image without fluctuation with elapse of time.

What is claimed is:

1. An electrophotographic photosensitive member comprising a photoconductive layer provided on an electroconductive substrate, said photoconductive layer comprising a non-single crystal material containing silicon atoms as a matrix and a surface layer provided on said photoconductive layer, said surface layer comprising non-single-crystal carbon containing at least fluorine, wherein said surface layer is formed using a gas consisting of (a) and (b), wherein (a) is $CH_4$ and (b) is $CF_4$, $CHF_3$ or a mixture thereof and wherein said surface layer has a ratio of an area of a peak having center at about 1200 $cm^{-1}$ or 1120 $cm^{-1}$ in an infrared absorption spectrum to an area of a peak having center at about 2920 $cm^{-1}$ being in a range from 0.1 to 50.

2. The electrophotographic photosensitive member according to claim 1, wherein said non-single-crystal material is an amorphous material containing hydrogen or halogen.

3. The electrophotographic photosensitive member according to claim 1, further comprising, between said photoconductive layer and said surface layer, an intermediate layer composed of SiC.

4. The electrophotographic photosensitive member according to claim 3, wherein said buffer layer comprises amorphous silicon carbide.

5. The electrophotographic photosensitive member according to claim 1, wherein said surface layer is formed by plasma deposition of said gas consisting of (a) and (b).

6. The electrophotographic photosensitive member according to claim 1, wherein said surface layer is formed by plasma chemical vapor deposition employing a high frequency of 1 to 450 MHz to form a plasma by decomposition of raw material gasses.

7. The electrophotosensitive photosensitive member according to claim 1, wherein said surface layer is formed by plasma chemical vapor deposition employing a high frequency of 50 to 450 MHz to form a plasma by decomposition of raw material gasses.

8. An image forming apparatus comprising:

a light-receiving member comprising a photoconductive layer on an electroconductive substrate, and a surface layer provided on said photoconductive layer, said surface layer comprising non-single-crystal carbon containing at least fluorine, and wherein said surface layer is formed using a gas consisting of (a) and (b), wherein (a) is $CH_4$ and (b) is $CF_4$, $CHF_3$ or a mixture thereof and wherein said surface layer has a ratio of an area of a peak having center at about 1200 $cm^{-1}$ or 1120 $cm^{-1}$ in an infrared absorption spectrum to a area of a peak having center at about 2920 $cm^{-1}$ being in a range from 0.1 to 50; and a charging unit, a developing unit and a cleaner provided in this order around said light-receiving member.

9. An image forming apparatus according to claim 8, further comprising an electrostatic image forming portion between said charging unit and said developing unit.

10. An image forming apparatus according to claim 9, further comprising a light source for irradiating said light-receiving member with light in said electrostatic image forming portion.

11. An image forming apparatus according to claim 8, wherein said cleaner has a blade which is in contact with said light-receiving member.

12. An image forming apparatus according to claim 8, further comprising, between said developing unit and said cleaner, a transfer material supplying system for supplying a transfer material and a charging unit for transferring a toner applied to said light-receiving member to the supplied transfer material.

13. An image forming apparatus according to claim 8, wherein said photoconductive layer comprises a non-single-crystal material containing silicon atoms as a matrix.

14. An image forming apparatus according to claim 13, wherein said non-single-crystal material is an amorphous material containing hydrogen or halogen.

15. An image forming apparatus according to claim 8 further comprising, between said photoconductive layer and said surface layer, an intermediate layer composed of SiC.

16. An image forming apparatus according to claim 15, wherein said buffer layer comprises amorphous silicon carbide.

* * * * *

UNITED STATES PATENT AND TRADEMARK OFFICE

CERTIFICATE OF CORRECTION

PATENT NO. : 6,322,943 B1
DATED : November 27, 2001
INVENTOR(S) : Makoto Aoki et al.

It is certified that error appears in the above-identified patent and that said Letters Patent is hereby corrected as shown below:

Column 5,
Line 2, "charge" should read -- charge of --.

Column 8,
Line 15, "plasuma obtain" should read -- plasma obtained --.

Column 21,
Line 35, "provide" should read -- providing --.

Column 22,
Line 15, "gasses." should read -- gases. --; and
Line 20, "gasses." should read -- gases. --.

Signed and Sealed this

Thirtieth Day of April, 2002

*Attest:*

*Attesting Officer*

JAMES E. ROGAN
*Director of the United States Patent and Trademark Office*